United States Patent [19]

Williams

[11] Patent Number: 4,828,038

[45] Date of Patent: May 9, 1989

[54] FOAM FIRE FIGHTING APPARATUS

[75] Inventor: Leslie P. Williams, Port Neches, Tex.

[73] Assignee: CCA, Inc., Port Neches, Tex.

[21] Appl. No.: 107,027

[22] Filed: Oct. 9, 1987

Related U.S. Application Data

[63] Continuation-in-part of Ser. No. 895,520, Aug. 11, 1986, abandoned, which is a continuation-in-part of Ser. No. 686,091, Dec. 24, 1984, abandoned, which is a continuation-in-part of Ser. No. 482,499, Apr. 6, 1983, Pat. No. 4,497,442, which is a continuation-in-part of Ser. No. 399,112, Jul. 16, 1982, abandoned.

[51] Int. Cl.[4] ..... A62C 35/46

[52] U.S. Cl. ..... 169/15; 169/14

[58] Field of Search ..... 169/14, 15, 66, 44; 239/317, 318, 428.5

[56] References Cited

U.S. PATENT DOCUMENTS

| | | | |
|---|---|---|---|
| 1,734,164 | 11/1929 | Faber | 169/15 |
| 2,089,646 | 8/1937 | Friedrich | 169/15 X |
| 2,388,508 | 11/1945 | Timpson | 169/14 X |
| 2,556,239 | 6/1951 | Tuve et al. | 169/14 X |
| 2,577,451 | 12/1951 | Clemens et al. | 169/15 |
| 2,761,516 | 9/1956 | Vassilkovsky | 169/15 |

FOREIGN PATENT DOCUMENTS

| | | | |
|---|---|---|---|
| 583153 | 9/1959 | Canada | 169/15 |
| 591697 | 8/1947 | United Kingdom | 169/15 |
| 804118 | 11/1958 | United Kingdom | 169/15 |

*Primary Examiner*—Sherman D. Basinger
*Assistant Examiner*—Paul E. Salmon
*Attorney, Agent, or Firm*—Pravel, Gambrell, Hewitt, Kimball & Krieger

[57] ABSTRACT

An apparatus for making foam using a foam concentrate, a liquid and a vapor comprises a primary cylinder defining a mixing chamber therein. An eductor is disposed substantially within the mixing chamber for drawing in foam concentrate while mixing the foam concentrate with a portion of the liquid entering the apparatus. A secondary cylinder defining a foam chamber therein is in flow communication with the primary cylinder at one end via a flow passage therebetween. The eductor extends through the flow passage and into the secondary cylinder thereby defining an annulus in the flow passage to allow a portion of the liquid in the primary cylinder to by-pass the eductor and enter the secondary cylinder. Vapor is drawn into the secondary cylinder to mix with the combined liquid stream from the annulus and the stream from the eductor to create foam in the secondary cylinder. The foam may be directed to a storage tank for fire-fighting.

15 Claims, 2 Drawing Sheets

FOAM FIRE FIGHTING APPARATUS

RELATED APPLICATIONS

This application is a continuation-in-part of application Ser. No. 895,520 filed Aug. 11, 1986 which is a continuation-in-part of application Ser. No. 686,091 filed Dec. 24, 1984, which is a continuation-in-part of application Ser. No. 482,499, filed Apr. 6, 1983, now U.S. Pat. No. 4,497,422 issued Feb. 5, 1985, which is a continuation-in-part of application Ser. No. 399,112, filed July 16, 1982, now abandoned.

BACKGROUND OF THE INVENTION

1. Field of the Invention

This invention relates to the field of foam forming equipment.

2. Description of the Prior Art

Fire-fighting nozzles for the application of a water stream or a water fog on a fire have been known for some time. Such nozzles are attached to a fire hose carrying a liquid stream, such as water, and frequently are adjustable to apply the fire-extinguishing liquid in a pattern ranging from a fog-like application to a straight stream, an example of which is made by Elkhart Brass Manufacturing Co., Inc. of Elkhart, Ind. However, an application of water is not desirable for all types of fires.

Fire-extinguishing foam-forming liquid compositions have been utilized in the extinguishing of certain types or classes of fires. Many of these foam-forming compositions will, when mixed with water and aerated with large quantities of air, form relatively stable foams, particularly for the extinguishing of large fires. Such liquid foam concentrates are known under the trademarks, Lightwater Brand ®, "AFFF/ATC" of Minnesota Mining and Manufacturing Company, Minnesota and "Emulsiflame ®" of Elkhart Brass Manufacturing Co., Inc. Other such foams are generally described in U.S. Pat. Nos. 3,772,195; 3,562,156; 3,578,590; and 3,548,949.

The foam-forming liquid compound has been generally supplied as a concentrate which was inducted into the flowing liquid stream by an in-line or by-pass foam eductor. The separate eductor was connected between the nozzle and the liquid stream pump or source. The foam concentrate was withdrawn by the eductor or pumped from the concentrate was withdrawn by the eductor or pumped from the concentrate storage and was then diluted and/or mixed with the liquid stream in the desired concentration. Thereafter, the foam-forming concentrate and liquid mix was aerated in a separate system, forming the foam which discharged from a nozzle.

Generally the foam applying nozzle used with the separate eductor has been of the same type utilized to apply water. Some water nozzles have had the stem-portion modified (the stem limits and assists in directing the water flow) for the application of the foam. These are non-aspirating peripheral jet nozzles.

Using such prior art concept and equipment, wherein the foam concentrate was first separately mixed with water and then the foam was generated by air aspiration and discharged through a nozzle, the distance the foam could be projected from the nozzle has been considerably shorter than the distance water alone could be projected through the nozzle. For example, with foam, the maximum distance was usually only about 170 feet whereas with water it was about 300 feet. The separate foam eductor limits the flow (gallonage per minute) and the line pressure to the nozzle. Typically, foam eductors handled between 30 and 250 gallons per minute; whereas, nozzles handled in excess of 1000 gallons per minute. The separate eductor constricted the complete flow of water creating a pressure drop of 30–40% across the eductor. This loss of pressure was created by the flow into the eductor working against backpressure due to the constriction. Thus, the previous separate foam eductor and nozzle limited the flow and range capabilities of the nozzle and required the firefighter to approach the fire more closely.

The discharge distance of foam has previously been increased using a balanced pressure proportioning system. This system included a pump, control valve and ratio flow controller (venturi) which introduced the foam concentrate under pressure into the hose behind the nozzle. Since this system was pressurized, the drop in pressure created by the separate eductor was reduced, which allowed the greater flow pressure to form at the nozzle. The balanced pressure proportioning system was rather cumbersome, required a power source for the pump, and was more expensive than the separate eductor and nozzle system.

Prior art in-line systems included what is known in the art as bladder tanks or pressure tanks. These are large tanks which have one compartment containing the concentrated foam-making solution and the second portion for holding water. The two portions were separated by a bladder or the water and foam concentrate commingled to some degree. The water portion was attached to a water intake line which always contained line pressure, but when needed for fighting a fire, water was introduced to the tank to increase the water pressure into the tank containing the foam solution plus the water. These prior art devices relied on a ratio flow controller (venturi) to mix the foam making concentrate and the water to make foam. This process resulted in essentially the same system as a balanced pressure system. The bladder tank replaced the pump used in the balanced pressure system. An additional disadvantage of the prior art systems was that using the pressure tank for mixing caused a significant time loss in replenishing the foam concentrate. The apparatus of the present invention results in a higher quality foam which signficantly increases the 25% drain time of the foam when applied in the tank. 25% drain time is defined as the amount of time 25% of the bubbles comprising the foam burst and form water, thereby losing some of the fire fighting blanketing capability.

SUMMARY OF THE INVENTION

An apparatus for making foam using a foam concentrate, a liquid and a vapor comprises a primary cylinder defining a mixing chamber therein. An eductor is disposed substantially within the mixing chamber for creating a reduced pressure to draw in foam concentrate and then mixing the foam concentrate with a portion of the water or other liquid entering the apparatus. A secondary cylinder defining a foam chamber therein is in flow communication with the primary cylinder at one end via a flow passage therebetween. The eductor extends through the flow passage and into the secondary cylinder with an annulus thus provided in the flow passage to allow a portion of the liquid in the primary cylinder to by-pass the eductor and enter the secondary cylinder. Vapor such as air is drawn into the secondary cylinder to mix with the combined liquid stream from the annulus and the stream from the eductor to create foam in the secondary cylinder. A backpressure is created for the foam to work against which it has been found improves the foam quality. The backpressure is created by either introducing the foam into the bottom of a head of flammable liquid in a storage tank or by reducing the opening size of the discharge line from the secondary cylinder.

DETAILED DESCRIPTION OF THE PREFERRED EMBODIMENT

The apparatus A of the present invention includes a foam-making assembly F, water delivery means W (shown schematically in FIG. 5), and foam concentrate delivery means C.

Water delivery means W can be a water system such as typically provided in many industrial plants for fire-fighting or can comprise of a lagoon or adjacent river as the source of water combined with a fire water pump which can be actuated on demand. Foam-making assembly F (FIG. 1) has a water inlet 10 with suitable connections thereon such as threads 12 to connect the appropriately sized water line W to the foam-making assembly F.

Figure 5:
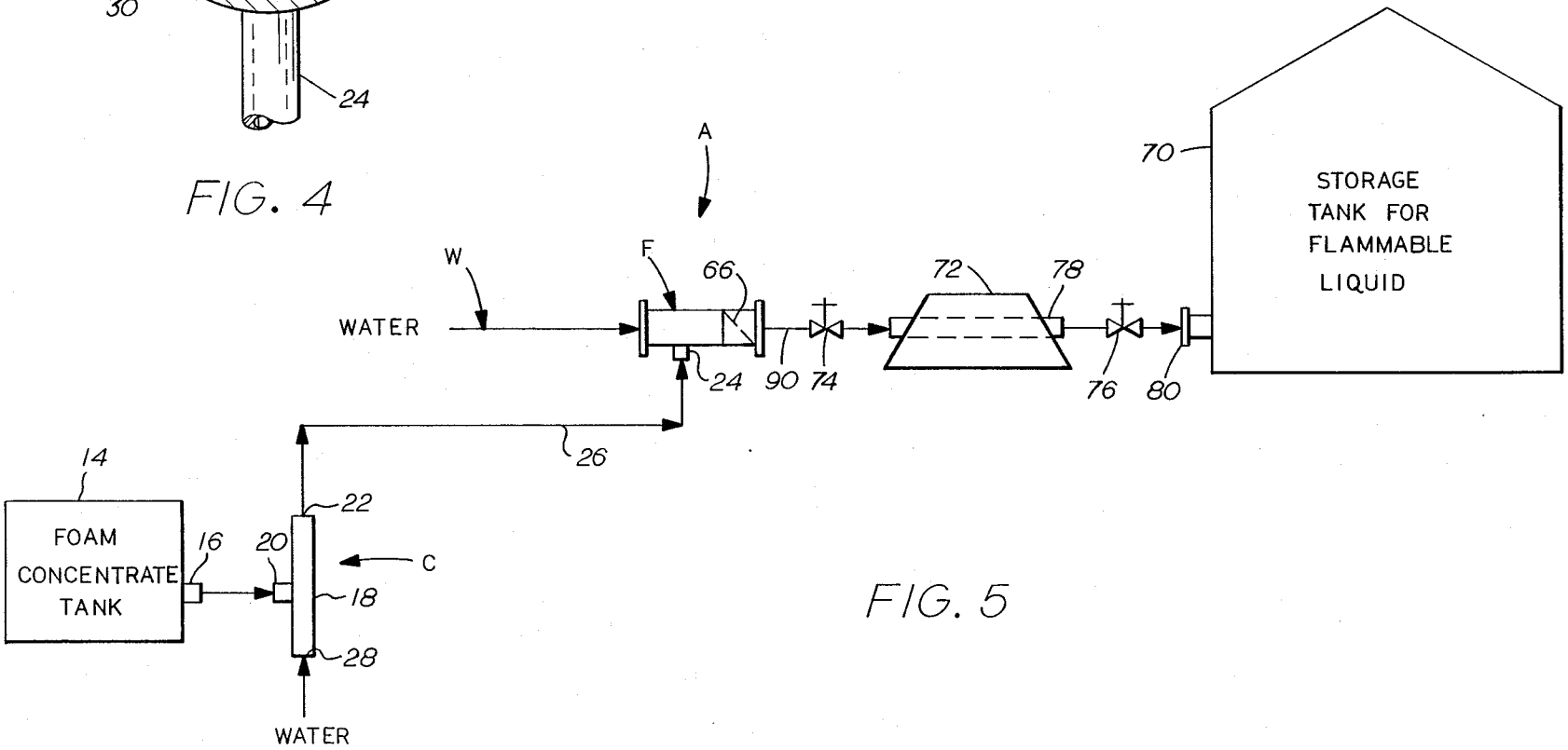
FIG. 5 is a schematic representation of a system for fighting storage tank fires with foam.

As shown in FIG. 5 foam concentrate delivery means C includes a foam concentrate tank 14 having an outlet 16. A foam concentrate eductor 18 has an inlet 20 in fluid communication with outlet 16 of foam concentrate tank 14. Foam concentrate eductor 18 has an outlet 22 which is in fluid communication with foam concentrate inlet 24 of foam-making assembly F via conduit 26. It is understood that if foam tank 14 is located physically above foam-making assembly F, the need for foam concentrate eductor 18 is obviated since the foam concentrated may flow by gravity directly into foam-making assembly F. Pressurized water coming from the same or a different source than water delivery means W is connected to water inlet 28 of foam concentrate eductor 18 and provides the motive force for drawing foam concentrate from tank 14 and delivering it to foam-making assembly F.

The quantity of foam concentrate delivered to foam-making assembly F is directly related to the flow rate from water delivery means W into foam-making assembly F.

Figure 1:
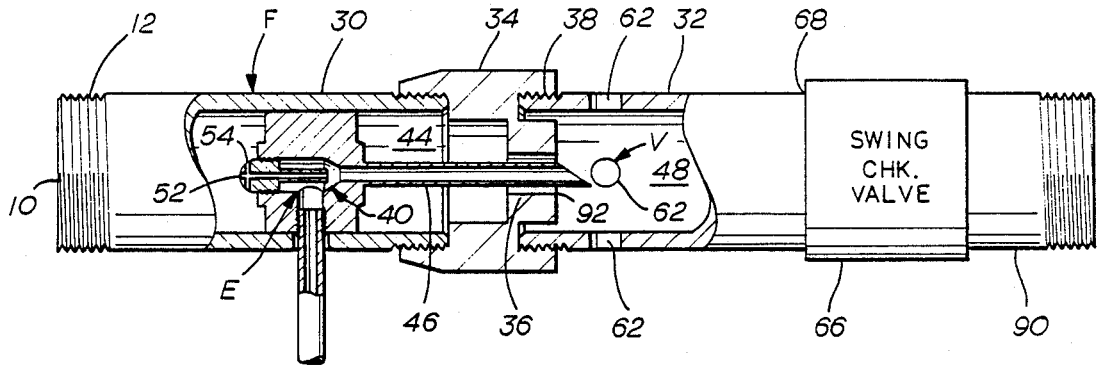
FIG. 1 is a partly sectional elevational view of the foam-making apparatus showing an embodiment suitable for connection to storage vessels below the liquid level therein.
Figure 2:
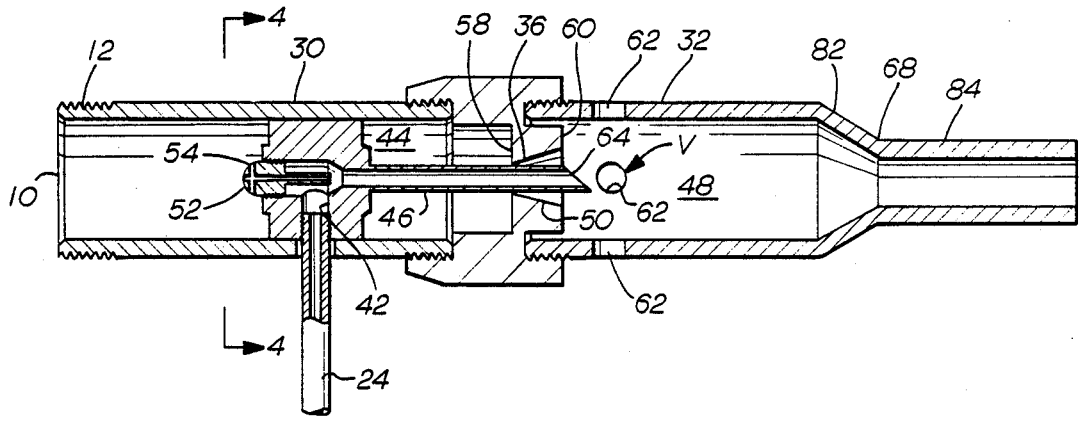
FIG. 2 is an elevational view of the foam-making apparatus showing another embodiment suitable for connection to a storage vessel above the operating liquid level or adapted for hand held use or alternately for monitor use.

As seen in FIG. 1 foam-making assembly F includes a primary tubular member 30 which may be a cylinder or have another cross-sectional shape and a secondary tubular member 32 which may be a cylinder or have another cross-sectional shape. Primary cylinder 30 has a closure 34 at the opposite end from threads 12. Closure 34 effectively seals off primary cylinder 30 except for flow passage 36 which allows fluid communication between primary cylinder 30 and secondary cylinder 32. Secondary cylinder 32 is connected to closure 34 by threads 38, although a different type of connection may be used without departing from the spirit of the invention. Accordingly, as shown in FIGS. 1 and 2, primary cylinder 30 and secondary cylinder 32 are aligned along their longitudinal axes.

Foam-making assembly F further includes eductor means E. Eductor means E includes an eductor 40 having a foam concentrate inlet 42 (FIG. 2) in fluid communication with foam concentrate inlet 24 of foam-making assembly F. Eductor 40 is disposed substantially within mixing chamber 44 which is defined as the interior space within primary cylinder 30. Eductor 40 has an outlet tube 46 which extends along the longitudinal axis of primary cylinder 30 through flow passage 36 and into foam chamber 48, defined as the interior space within secondary cylinder 32. Accordingly, an annulus 50 is defined in flow passage 36 in the gap between the outer surface of outlet tube 46 and the opening in closure 34.

Water entering inlet 10 which is typically at pressures ranging from 50 to 150 pounds enters inlet 10 and follows two parallel flow paths. A portion of the water enters eductor 40 through a main water inlet 52 as well as a slot 54 in flow communication with inlet 52. The remaining water stream flows in substantially laminar non-turbulent flow around eductor 40, through mixing chamber 44 and through annulus 50 into foam chamber 48.

The slot 54 extends in a plane perpendicular to the longitudinal axis of primary cylinder 30 and provides alternative openings to the main opening 52 so that in the event debris carried in with the incoming water stream plugs up opening 52, alternative openings 54 are available through slot 54 to continue water flow into eductor 40.

Figure 3:
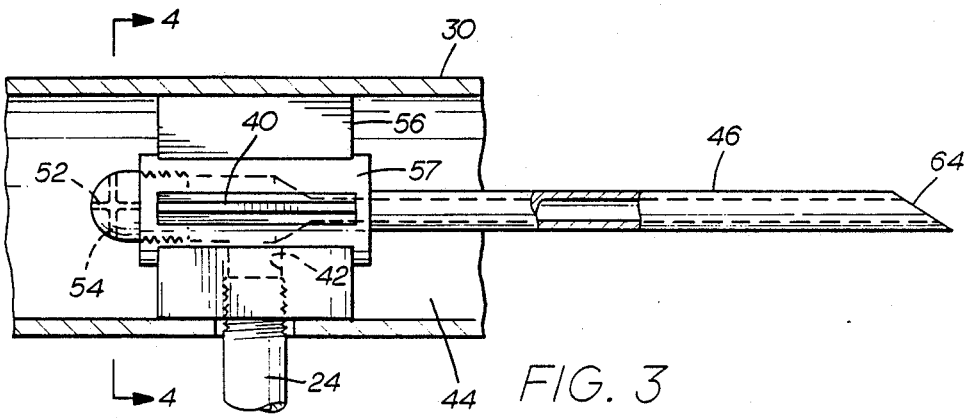
FIG. 3 is a detail of the eductor means in the primary cylinder of FIGS. 1 and 2.
Figure 4:
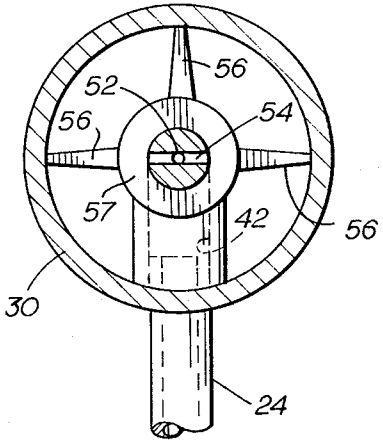
FIG. 4 is a sectional elevational view taken along lines 4—4 of FIG. 3.

The balance of the water stream flowing through mixing chamber 44 flows longitudinally past a plurality of support vanes 56 (see FIG. 4) which extend radially from the longitudinal axis of primary cylinder 30 at fixed intervals to each other. As shown in FIG. 4, one possible layout of vanes 56 is to have them disposed at 90 degrees to each other, for example. Vanes 56 may be fabricated integrally with an eductor housing 57 and the inlet 42 or each vane 56 may be individually constructed and attached to the housing 57. As shown in FIGS. 1–3, vanes 56 are disposed adjacent eductor 40 within mixing chamber 44. Such vanes assist in maintaining essentially laminar flow of the water flowing through the primary cylinder 30. By reason of such laminar flow, the apparatus of this invention is capable of producing denser foam, for example, in the range of from about 2:1 to about 4:1, i.e. the foam produced is two to four times the volume of the water which is introduced at inlet 10. Such dense foams are more easily delivered greater distances without the use of auxiliary gas under pressure than with less dense foams.

The operation of eductor 40 in using the fluid pressure of water entering inlet 52 and slot 54 is to create a reduced pressure, thereby drawing in foam concentrate from conduit 26 as has been described in detail in U.S. Pat. No. 4,497,442, issued Feb. 5, 1985 by Leslie P. Williams and whose entire specification is incorporated by reference herein as if fully set forth. As stated in the above-mentioned patent, the amount of water entering eductor 40 determines the volume of foam concentrate and water entering foam concentrate inlet 24 of foam-making assembly F. The motive water entering inlet 52 and slot 54 carries the mixture of foam concentrate and water from conduit 26 through outlet tube 46 into foam chamber 48. The balance of the liquid stream flowing through mixing chamber 44 passes through annulus 50 whereupon it combines with the stream exiting outlet tube 46 to aid in generating the foam. Thus, turbulence in the fluid flow is crated essentially only in the secondary cylinder 32 where the foam is thus generated. The result is a foam with smaller, more homogenous bubbles so that a better quality, denser foam is created than that of the prior art where turbulence occurs at the eductor or earlier.

Although flow passage 36 is shown to be a straight bore in FIG. 1, it has been determined that a tapered bore section beginning adjacent inner wall 58 (FIG. 2) and extending a distance of approximately 0.020 inches to outer wall 60 of closure 34 provides several advantages. It has been found that a taper angle measured from the longitudinal axis of primary cylinder 30 of about 5 degrees, for example, increases turbulence within foam chamber 48 and further directs the water stream flowing through annulus 50 beyond air or vapor inlet openings 62 in secondary cylinder 32 to cause the liquid coming through the annulus to hit the inside wall of the chamber 32. The particular taper angle is not critical, since the taper is primarily to cause the water and chemical to hit the wall of chamber 32 to create turbulence and form the foam.

As illustrated in FIG. 2, it has been found that operation of foam-making assembly F with a backpressure in foam chamber 48 comprising approximately 20 percent of the operating pressure at the inlet 10 to primary cylinder 30 produces a foam which has small essentially uniform sized bubbles in the foam which significantly improves the foam quality, i.e. the 25 percent drain time of the foam thereby produced.

The backpressure is crated in foam chamber 48 by a tapered section 82 adjacent foam outlet 68 which connects to outlet pipe 84 of a reduced diameter compared to the diameter of the cylinder 32. The tapered section 82 is for maintaining a higher discharge pressure at the foam outlet 68 in the foam chamber 48 than if the foam were conducted in a pipe of the same or larger diameter than the diameter of the cylinder 32.

In order to produce foam in chamber 48 in either FIG. 1 or 2, vapor induction means V comprising openings 62 in the wall of secondary cylinder 32 allows the surrounding air or other vapor to be drawn into foam chamber 48 to mix with the liquid so that bubbles are created in the liquid, thus resulting in the formation of foam. In effect, the surrounding air is induced to flow into foam chamber 48 due to a reduced pressure area adjacent opening 62. For example and not by way of limitation, if primary cylinder 30 and secondary cylinder 32 are a 2½ inch diameter pipe, four equally spaced openings 62, each being ½ inch in diameter may be used. Such openings should be disposed in a plane perpendicular to the longitudinal axis of secondary cylinder 32 and adjacent the tip of outlet tube 46. Additionally, it has also been found that externally beveling the outlet end 64 of outlet tube 46 to an angle between 30 and 45 degrees measured from the longitudinal axis of extension tube 46 greatly improves the "eductor effect" experienced in foam chamber 48 which draws in surrounding air through openings 62 to aid in bubble formation when the foam is produced.

As seen in FIGS. 1 and 5, a swing check valve 66 preferably of the type shown in the "Chemical Engineers' Handbook," 5th Edition, page 6–56, by Robert H. Perry and Cecil H. Chilton, is connected to secondary cylinder 32 adjacent foam outlet 68. Suitable piping 90 (FIGS. 1 and 5) is provided to connect check valve 66 with storage tank 70. Storage tank 70 contains a flammable fluid and therefore is surrounded by a dike 72 to contain any fluids spilled in the event of a leak or a tank rupture. Accordingly, piping between check valve 66 including valves 74 and 76 are used to deliver foam into tank 70 below the liquid level therein. A sleeve 78 is used in dike 72 to provide an opening for the foam line therethrough. It is desirable that inlet flange 80 on tank 70 and any internal piping within tank 70 connected to inlet flange 80 be suitably sized to limit the foam velocity therein to 10 feet per second or less for tanks containing hydrocarbons with a flash point of 100° F. or less and to a maximum of 20 feet per second for hydrocarbons having a flash point of 100° F. or greater. Check valve 66 further provides assurances against backflow of flammable hydrocarbons from storage tank 70 through valves 74 and 76 and to the atmosphere through openings 62. Foam outlet line 90 refers to the entire line from the check valve 66 to the storage tank 70 and it is preferably unobstructed over its entire length. Since the check valve 66 is a swing check valve, when it is open, it does not provide any significant obstruction to the flow of the foam. The term "unobstructed" as used herein means that the internal parts of the pipe, valves, and conduits from the mixing chamber 48 to the tank 70 are free of internal projections which would otherwise significantly impede the flow of the foam. The foam chamber 48 is unobstructed up to the check valve 66 in FIG. 1 and up to the reduced diameter formed by the taper 82 in FIG. 2. The check valve 66, if of the swing check valve type, does not provide any significant obstruction. The reduced diameter at the taper 82 in FIG. 2 is not an obstruction as that term is used herein.

The embodiment shown in FIG. 2 is used to either directly connect foam outlet 68 to a point adjacent the top of storage tank 70 above the liquid surface therein or alternatively to allow the entire foam-making assembly F to be hand held by an operator, lifted in a basket by a crane to a point adjacent an engulfed tank for spraying foam thereon, or is monitor mounted. Since the embodiment shown in FIG. 2 is piped in fluid communication with tank 70 adjacent its roof or for use in a hand held fashion, the backpressure provided by introducing the foam at the bottom of the liquid level head in the configuration shown in FIG. 5 is not present. As explained above in connection with FIG. 2, the tapered segment 82 reduces the size of foam outlet 68 thereby creating a backpressure in foam chamber 48 adjacent foam outlet 68. The provision of backpressure using the FIG. 1 apparatus with the FIG. 5 storage tank arrangement, and the provision of backpressure with the FIG. 2 apparatus causes the generation of smaller more uniform homogenous bubbles which increases the 25% drain time significantly, thereby providing a higher quality foam than if the backpressure is not present. If the embodiment of FIG. 2 is piped to the roof of the tank 70 it may optionally have a swing check valve in the line connecting foam outlet 68 to tank 70 to prevent backflow of flammable liquid from the tank 70.

When used in a hand held fashion, the outlet pipe or extension wand 84 connected to foam outlet 68 allows the operator to stand further back from the engulfed vessel as he directs the foam to the storage tank 70. The extension wand may also be hung on the tank prior to introducing foam water. It should be noted that the embodiment shown in FIG. 2 may also be useful for double wall tanks to provide foam to the annular space in between the two vessels.

The induction of air through openings 62 (or any other suitable vapor) promotes uniform bubble creation in foam chamber 48. The uniform bubbles created in foam chamber 48 improve the 25 percent drain time of the foam within tank 70. As shown in FIG. 5, foam injected through nozzle 80 floats through the liquid contents in storage tank 70 to the liquid surface therein. Once the foam flows to the liquid surface, it effectively isolates the burning contents from a necessary oxygen source thereby choking off the fire. The 25 percent drain time factor is improved in that the ability of the foam to keep the fire out is greatly dependent upon the length of time a continuous blanket can be maintained on the liquid surface to effectively isolate air from the contents in the tank. It should be noted that once the integrity of the foam layer is interrupted, the hot tank walls as a result of the fire may in combination with a spark and an air source re-ignite a fire in the tank. Accordingly increasing the 25 percent drain time with the apparatus of the present invention, which is the time it takes for 25 percent of the bubbles in the foam layer to collapse, from times previously experienced in the order of 4 to 8 minutes to approximately 14 minutes, greatly improves the effectiveness of the apparatus A of the present invention in fighting tank fires as compared to the prior art.

In operation, as seen in FIG. 5, if a fire develops in storage tank 70, appropriate valving (not shown) on water delivery means W is operated manually or automatically to cause water under pressure to enter water inlet 10 (FIG. 1). Also, a water valve (not shown) is opened to cause water under pressure to flow into water inlet 28 of foam concentrate eductor 18. Having thus initiated the flow of foam concentrate from tank 14 into foam-making assembly F, valves 74 and 76 are manually or automatically operated to open to allow foam to flow from foam-making assembly F into the bottom of the storage tank 70. Because the foam is of less density than the flammable liquid in the tank 70, the foam flows upwardly through the liquid level in storage tank 70 and flows to the top thereby forming a blanket to exclude air from the engulfed contents thereby extinguishing the fire. It should be noted that although water has been used as the motive force to generate foam in foam-making assembly F, other liquids may be used without departing from the spirit of the invention. Similarly, other vapors, other than the surrounding air may be induced to flow into foam chamber 48 through openings 62 without departing from the spirit of the invention.

Thus, in the form of the invention shown in FIGS. 1 and 5, the high quality foam is produced by the backpressure created by the head of flammable liquid against which the foam is introduced into the storage tank 70. Such backpressure is generally of the same magnitude as the backpressure provided by the reduced diameter structure of FIG. 2 which has the diameter reduction from the cylinder 32 to the outlet wand or pipe 84. Usually the head pressure of the flammable liquid is less than about 25% of the water pressure at inlet 10 which creates a sufficient backpressure for the production of the smaller homogeneous substantially uniform bubbles in the foam like that produced also in the FIG. 2 apparatus.

The foregoing disclosure and description of the invention are illustrative and explanatory thereof, and various changes in the size, shape and materials, as well as in the details of the illustrated construction may be made without departing from the spirit of the invention.

I claim:

1. A foam fire fighting system comprising:

a foam making assembly having a liquid inlet, a foam concentrate inlet, and a foam outlet line;

means for delivering a liquid under pressure to said liquid inlet;

means for delivering foam concentrate to said foam concentrate inlet;

said foam making assembly further comprising:

a primary tubular member having a longitudinal axis and an inlet and an outlet and defining a mixing chamber therebetween;

eductor means supported and disposed substantially within said mixing chamber for creating a reduced pressure in said primary tubular member for drawing foam concentrate from said foam concentrate delivery means while mixing said foam concentrate with a portion of the liquid delivered to said liquid inlet;

a secondary tubular member defining a foam chamber therein;

said secondary tubular member having an internal surface and having one end in flow communication with said outlet of said primary tubular member via a flow passage therebetween, and said secondary tubular member having a foam outlet at its opposite end from said primary tubular member;

said primary tubular member being substantially unobstructed throughout its length for providing essentially laminar flow of the liquid therethrough from said inlet to said outlet;

said eductor means extending through said flow passage into said secondary tubular member, thereby defining an annulus in said flow passage to allow a portion of the liquid in said primary secondary tubular member to by-pass said eductor means enter said tubular member; and vapor induction means with said secondary tubular member for allowing vapor to be drawn into said secondary tubular member to mix with the combined liquid stream from said annulus and said stream from said eductor means with turbulence to create foam in said secondary tubular member; and a plurality of vanes extending radially from the longitudinal axis of said primary tubular member for promoting the laminar flow of the liquid in said primary tubular member.

2. The system of claim 1, wherein said secondary tubular member has a longitudinal axis and said vapor induction means further includes:

a plurality of openings in said secondary tubular member circumferentially spaced in a plane perpendicular to the longitudinal axis of said secondary tubular member adjacent the outlet of the eductor means.

3. The system of claim 2, wherein:

said flow passage has a taper which increases from a smaller opening to a larger opening in the direction from said primary tubular member to said secondary tubular member for causing the liquid flowing through said annulus to be directed past said circumferentially spaced openings in said secondary tubular member before impinging on the internal surface of said secondary tubular member for creating turbulence in said foam chamber.

4. The system of claim 3, wherein:

said taper is about five degrees.

5. The system set forth in claim 1, including:

backpressure means for providing a back pressure in said foam chamber in proximity to said foam outlet for creating small sized substantially uniform bubbles in the foam of a higher quality than produced in the absence of said backpressure.

6. The system set forth in claim 5, wherein:

said secondary tubular member has a cross-section; and said backpressure means is provided by a reduced cross-section at said foam outlet as compared to a cross-section of said secondary tubular member.

7. The system set forth in claim 5, wherein:

said backpressure means is provided by a head of flammable liquid, the lower portion of which is in fluid communication with said foam outlet.

8. The system of claim 7, including:

a storage tank for said flammable liquid; and a flow line with at least one valve therein connecting said foam outlet with the bottom part of said storage tank, said flow line being substantially unobstructed when said valve is open.

9. The system of claim 1, wherein said eductor means includes:

a plurality of liquid inlets in flow communication with each other to insure continued liquid flow into said eductor means if any of said inlets plug with debris carried by the liquid flowing into said mixing chamber.

10. The system set forth in claim 1, wherein:

said foam chamber of said secondary tubular member is unobstructed from said one end to said opposite end.

11. An apparatus for making foam using a foam concentrate, a liquid and a vapor, said apparatus having a liquid inlet, a vapor inlet, foam concentrate inlet and a foam outlet and further comprising:

a primary tubular member defining a mixing chamber therein;

eductor means substantially within said mixing chamber for drawing in foam concentrate while mixing said foam concentrate with a portion of the liquid delivered to said liquid inlet;

a secondary tubular member defining an unobstructed foam chamber therein;

said foam chamber having means for providing a backpressure adjacent its foam outlet by promoting turbulence in said foam chamber and the creation of a substantially uniform bubble size;

said secondary tubular member being in flow communication with said primary tubular member at one end via a flow passage therebetween, and having said foam outlet at its opposite end;

said eductor means extending through said flow passage into said secondary tubular member, thereby defining an annulus in said flow passage to allow a portion of the liquid in said primary tubular member to by-pass said eductor means and enter said secondary tubular member and thereby form a combined liquid stream;

said mixing chamber providing minimal resistance to flow resulting from internal projections therein, of liquid by-passing said eductor means, said resistance being created substantially entirely by said eductor means and its support;

vapor induction means with said secondary tubular member for allowing vapor to be drawn into said secondary tubular member to mix with a combined liquid stream from said annulus and said eductor means to create foam in said secondary tubular member; and a tip segment extending from said foam outlet and located outwardly of said means for providing a backpressure to assist in directing the flow of foam created by the apparatus, said tip segment having an unobstructed flow path over its entire length.

12. A foam fire fighting system for storage tanks comprising:

a foam making assembly having a liquid inlet, a foam concentrate inlet, and a foam outlet line;

means for delivering a liquid under pressure to said liquid inlet;

means for delivering foam concentrate to said foam concentrate inlet;

said foam making assembly further comprising:

a primary tubular member having a longitudinal axis and defining a mixing chamber therein;

eductor means substantially within said mixing chamber for drawing foam concentrate from said foam concentrate delivery means while mixing said foam concentrate with a portion of the liquid delivered to said liquid inlet;

a secondary tubular member defining a foam chamber therein;

said secondary tubular member having one end in flow communication with one end of said primary tubular member via a flow passage therebetween, and said secondary tubular member having a foam outlet at its opposite end from said primary tubular member;

said foam chamber of said secondary tubular member being unobstructed from said one end to said opposite end;

said foam chamber having means for providing a backpressure adjacent said foam outlet thereby promoting turbulence in said foam chamber and a creation of a substantially uniform bubble size;

said eductor means extending through said flow passage into said secondary tubular member, thereby defining an annulus in said flow passage to allow a portion of the liquid in said primary tubular member to by-pass said eductor means and enter said tubular member;

vapor induction means with said secondary tubular member for allowing vapor to be drawn into said secondary tubular member to mix with a combined liquid stream from said annulus and said eductor means to create foam in said secondary tubular member;

valve means mounted in said foam outlet line;

said line extending from said foam outlet and being unobstructed over its entire length when said valve means is open;

said primary tubular member further includes a plurality of vanes extending radially from the longitudinal axis of said primary tubular member;

said eductor means further includes a plurality of liquid inlets in flow communication with each other to insure continued liquid flow into said eductor means if any of said inlets plug with debris carried by the liquid flowing into said mixing chamber;

said vapor induction means further includes a plurality of openings in said secondary tubular member circumferentially spaced in a plane perpendicular to the longitudinal axis of said secondary tubular member adjacent the outlet of said eductor means;

said flow passage has an increasing taper in the direction from said primary to said secondary tubular member, whereupon the liquid flowing through said annulus is directed past said circumferentially spaced openings in said secondary tubular member before impinging on a wall of said foam chamber;

said flow passage has a taper of about five degrees; and the outlet of said eductor means extending into said foam chamber has an externally beveled tip ranging from thirty to forty-five degrees measured from the longitudinal axis of said foam chamber.

13. An apparatus for making foam using a foam concentrate a liquid and a vapor, said apparatus having a liquid inlet, a vapor inlet, foam concentrate inlet and a foam outlet and further comprising:

a primary tubular member defining a mixing chamber therein;

eductor means substantially within aid mixing chamber for drawing in foam concentrate while mixing said foam concentrate with a portion of the liquid delivered to said liquid inlet;

a secondary tubular member defining an unobstructed foam chamber therein;

said foam chamber having means for providing a backpressure adjacent its foam outlet thereby promoting turbulence in said foam chamber and the creation of a substantially uniform bubble size;

said secondary tubular member in flow communication with said primary tubular member at one end via a flow passage therebetween, and having said foam outlet at its opposite end;

said eductor means extending through said flow passage into said secondary tubular member, thereby defining an annulus in said flow passage to allow a portion of the liquid in said primary tubular member to by-pass said eductor means and enter said secondary tubular member;

vapor induction means with said secondary tubular member for allowing vapor to be drawn into said secondary tubular member to mix with the combined liquid stream from said annulus and said stream from said eductor means to create foam in said secondary tubular member;

a tip segment extending from said foam outlet to assist in directing the flow of foam created by the apparatus, said tip segment having an unobstructed flow path over its entire length;

said eductor means further includes a plurality of liquid inlets in flow communication with each other to insure continued liquid flow into said eductor means if any of said inlets plug with debris carried by the liquid flowing into said mixing chamber;

said vapor induction means further includes a plurality of openings in said secondary tubular member circumferentially spaced in a plane perpendicular to the longitudinal axis of said secondary tubular member adjacent the outlet of said eductor means;

said flow passage has an increasing taper in the direction from said primary to said secondary tubular member, whereupon the liquid flowing through said annulus is directed past said circumferentially spaced openings in said secondary tubular member before impinging on a wall of said foam chamber;

said flow passage has a taper of about five degrees; and said outlet of said eductor means extending into said foam chamber has an externally beveled tip ranging from thirty to forty-five degrees measured from the longitudinal axis of said foam chamber.

14. A foam fire fighting system, comprising:

a foam making assembly having a liquid inlet, a foam concentrate inlet, and a foam outlet line;

means for delivering a liquid under pressure to said liquid inlet;

means for delivering foam concentrate to said foam concentrate inlet;

said foam making assembly further comprising:

a primary tubular member having a longitudinal axis and an inlet and an outlet and defining a mixing chamber therebetween;

eductor means supported and disposed substantially within said mixing chamber for creating a reduced pressure in said primary tubular member for drawing foam concentrate from said foam concentrate delivery means while mixing said foam concentrate with a portion of the liquid delivered to said liquid inlet;

a secondary tubular member defining a foam chamber therein;

said secondary tubular member having an internal surface and having one end in flow communication with said outlet of said primary tubular member via a flow passage therebetween, and said secondary tubular member having a foam outlet at its opposite end from said primary tubular member;

said primary tubular member being substantially unobstructed throughout its length for providing essentially laminar flow of the liquid therethrough from said inlet to said outlet;

said eductor means extending through said flow passage into said secondary tubular member, thereby defining an annulus in said flow passage to allow a portion of the liquid in said primary tubular member to by-pass said eductor means and enter said secondary tubular member;

vapor induction means with said secondary tubular member for allowing vapor to be drawn into said secondary tubular member to mix with the combined liquid stream from said annulus and said stream from said eductor means with turbulence to create foam in said secondary tubular member; and said eductor means including a tube which has a tip end disposed in said secondary tubular member and which is externally beveled at an angle between about thirty and forty-five degrees relative to the longitudinal axis of said tube.

15. The system of claim 14, wherein:

said flow passage has a taper which increases from a smaller opening to a larger opening in the direction from said primary tubular member to said secondary tubular member for causing the liquid flowing through said annulus to be directed past said circumferentially spaced openings in said secondary tubular member before impinging on the internal surface of said secondary tubular member for creating turbulence in said foam chamber.

* * * * *